United States Patent [19]

Washnock et al.

[11] 4,084,813

[45] Apr. 18, 1978

[54] TOE BOARD AND MEASURING MEANS

[76] Inventors: Robert S. Washnock, 395 Brown St., Akron, Ohio 44308; Delbert R. Madzay, 357 W. Turkeyfoot Lk. Rd., Akron, Ohio 44319

[21] Appl. No.: 724,024

[22] Filed: Sep. 16, 1976

[51] Int. Cl.[2] ..... A63B 65/04

[52] U.S. Cl. ..... 272/106; 33/138

[58] Field of Search ..... 272/105, 106, 107, 108; 33/138

[56] References Cited

U.S. PATENT DOCUMENTS

| | | | |
|---|---|---|---|
| 2,180,389 | 11/1939 | Austin | 272/106 |
| 2,200,223 | 5/1940 | Brown | 33/138 |

FOREIGN PATENT DOCUMENTS

| | | | |
|---|---|---|---|
| 1,225,345 | 9/1975 | France | 33/138 |

*Primary Examiner*—Jerome Schnall

*Attorney, Agent, or Firm*—Reese Taylor

[57] ABSTRACT

An improved toe board for athletic events is disclosed wherein the board has an elongate internal channel which forms a track extending substantially along the longitudinal axis thereof. A retractable tape measure is received within the track for movement therealong and an access opening is provided in the front face of the board in communication with the track so that the end tape is accessible and may be pulled out therefrom. Another access opening is provided along the top surface of the board so that a handle may be employed to move the tape measure along the track for measuring purposes.

4 Claims, 4 Drawing Figures

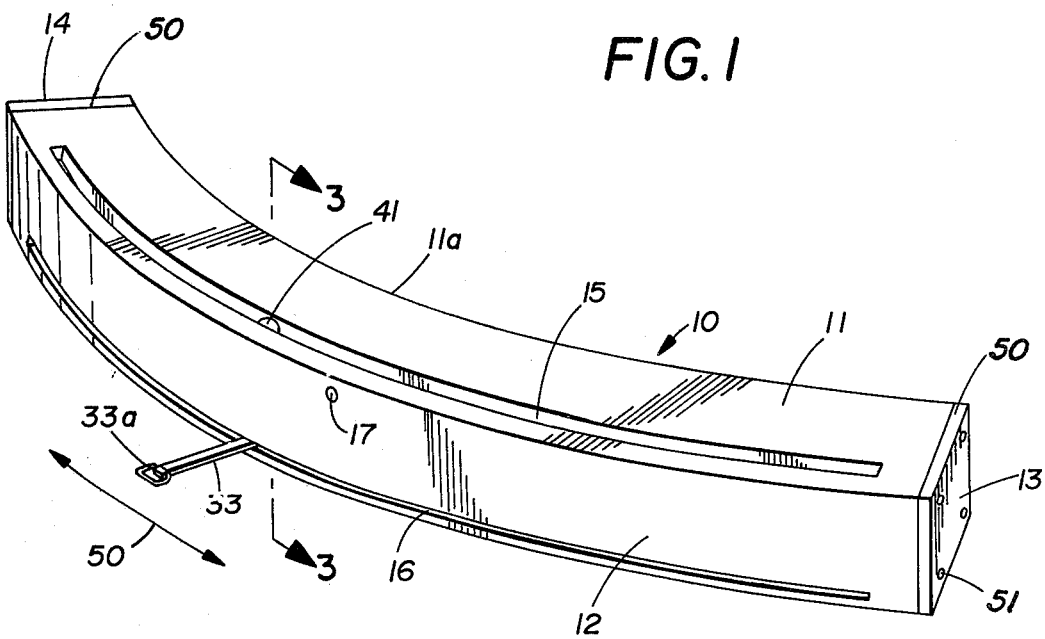
FIG. 1
FIG. 2
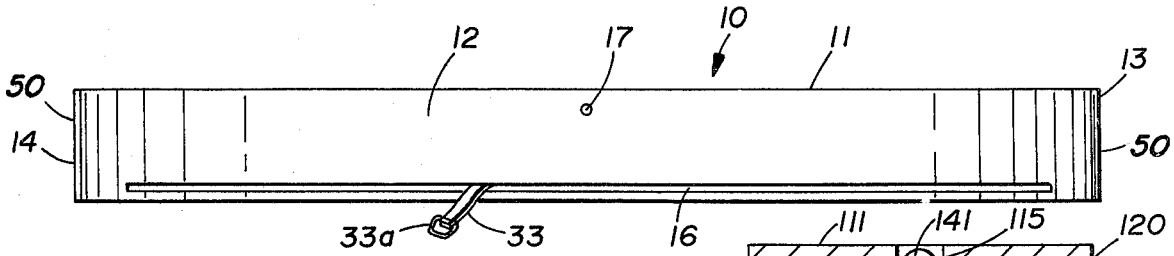
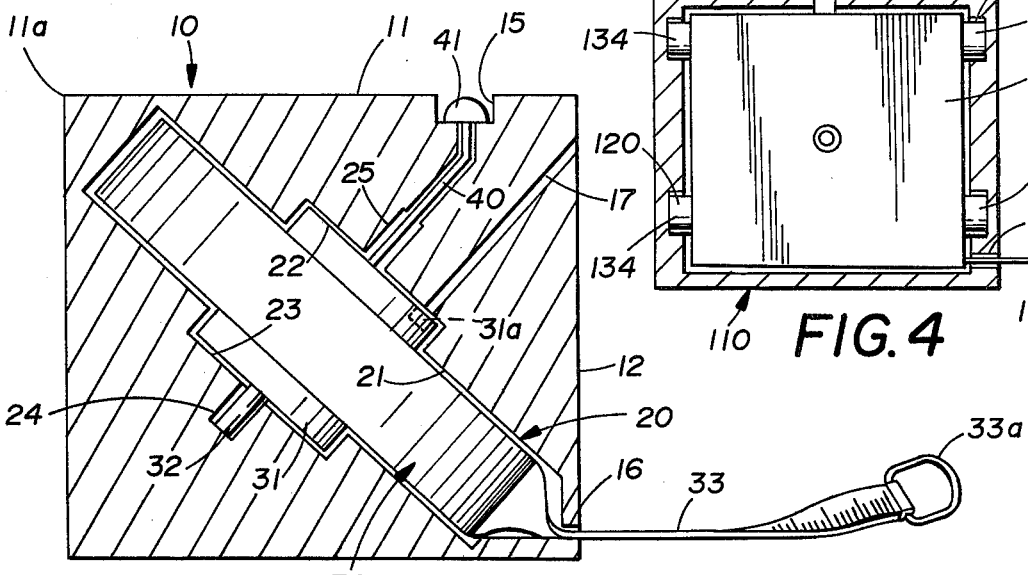
FIG. 3
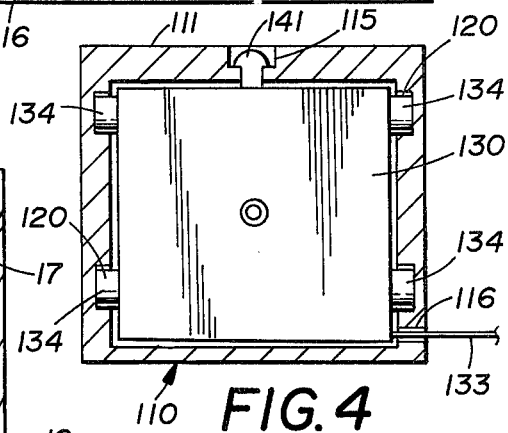
FIG. 4

TOE BOARD AND MEASURING MEANS

FIELD OF THE INVENTION

This invention relates, in general, to toe boards for use in athletic events and in particular relates to an improved toe board with self-contained measuring means.

DESCRIPTION OF THE PRIOR ART

In various athletic events, such as the shot put, discus throw or hammer throw, a metal ring is generally placed on the ground with the contestant being required to stay within the confines of the ring while delivering the article being thrown. Conventionally an enlarged or raised member called a toe board is affixed to one arcuate segment of the ring so as to limit the movement of the athlete toward the target area and prevent fouling.

Furthermore, in these athletic events, the general method of measuring the distance thrown is by utilization of a tape measure with one end being placed manually against the forward edge of the toe board and with the other end being drawn out to the point of impact of the object. The measurement is then taken.

One of the practical difficulties often encountered in utilizing conventional apparatus is that while the ring and the toe board are normally more or less permanently put in place at the site of the athletic event, it is often quite difficult to locate a tape measure either because of neglect or forgetfulness. Additionally, the retractable tape measure generally used are susceptible to damage through careless use.

It has been found, however, that these disadvantages can be readily overcome by the present invention.

SUMMARY OF THE INVENTION

Thus, it has been found that if a toe board which is in all other respects conventional is provided with an elongate internal channel forming a track extending along its longitudinal axis that a tape measure, preferrably of the retractable type, can be placed within this track for movement along the axis of the toe board.

It has also been found that if an access opening is provided in the forward face of the board and a second access opening is provided in the top surface that a handle can be employed and actuated from the top surface to move the tape to a position roughly opposite the point of impact of the article thrown.

Furthermore, the end of the tape can them simply be drawn out from the first access opening and a measurement taken following which the tape can be retracted either automatically or mannually depending upon the type of the tape measure employed.

In this fashion, it has been found that since the board and the ring are more or less permanently affixed to the ground at the site of the event, the tape will always be present and readily available for use.

Accordingly, production of an improved toe board and measuring devide of the character above described becomes the principal object of this invention with other objects thereof becoming more apparent upon a reading of the following brief specification considered and interpreted in view of the accompanying drawings.

OF THE DRAWINGS:

FIG. 1 is a perspective view showing the improved toe board and measuring apparatus.

FIG. 2 is a front elevational view.

FIG. 3 is a sectional view taken along the line 3—3 of FIG. 1.

FIG. 4 is a sectional view similar to FIG. 3 showing a modified form of the invention.

BRIEF DESCRIPTION OF THE PREFERRED EMBODIMENT

Referring first then to FIG. 1 of the drawings, it will be noted that the improved toe board, generally indicated by the numeral 10, includes a top surface 11, a front surface 12 and, opposed ends 13 and 14, with the general configuration being conventional in that, in cross section, the toe board is essentially rectangular. The ends 13,14 are closed off by end caps 50,50 which are held in place by screws 51,51.

It will be noted also, that top surface 11 has an elongate access opening in the form a slot 15 disposed therein and extending parallel to the longitudinal axis of the board 10.

A similar elongate access opening or slot 16 is disposed in the front face 12 and generally extends in the same direction and for the distance as the opening 15.

Referring to FIG. 3, it will be noted that interiorly of the board 10 is a channel which forms a track 20, with this track extending again generally along the longitudinal axis of the board 10 and having a length dimension substantially approximating the length dimension of the access openings 15 and 16.

Track 20 includes a main channel 21 and opposed reduced diameter auxilary channels 22 and 23 opening on opposed sides of main channel 21. Opening into auxilary channels 22 and 23 are reduced bores 24 and 25.

In the form of the invention shown in FIGS. 1 through 3, track 20 is disposed at an angle with respect to the top and bottom surfaces of the board and is capable of receiving the tape measure 30. This measure 30 has spool element 31 with tape 33 being wrapped around the spool element. Also, projecting from one side of the spool 31 is a swivel pin 32 which rests in recess 24 of the track 20 so that the tape may roll along the track 20 with the spool being received in auxilary channels 22 and 23 as will be described.

Access opening 15 which opens through the top surface 11 of the board is intended to receive a handle 40 which is generally an elongate shank attached to the spool 31 of the tape measure and having a knob or other type of grasping means 41 extending upward into the top opening of the access opening 15. This shank extends through opening 15 and bore 25 to engage the roller.

In this fashion it is possible, by grasping the handle 41, to move the tape measure 30 along the track 20 in the direction of the arrow 50 so that, depending upon the landing point of the object, a measurement can be taken by simply pulling exposed end **33*a* of the tape 30 out through the opening 16 to the point of impact. It is then simply necessary to read the tape in the plane of the front surface 12** to ascertain the distance of the throw.

In this regard, measurements are normally taken from the rear edge **11*a* of the board. However, it is contemplated that the indicia on the tape can be placed so as to compensate for the thickness of the board so that accurate measurements can be taken directly from the tape without the need for any addition or subtraction. Assuming the tape measure 30 to be a normal spring-loaded retractable type, it is then merely necessary to release end 33***a* to permit the tape 33 to be rewound on the spool 31.

In the event the tape 30 is not of the retractable type or in the event it should jam for any reason, a second opening 17 is provided in the face 12 with this opening consisting of a through bore which is capable of receiving a winding tool. This winding tool (not shown) can be inserted in opening 17 to engage recess 31*a* in spool 31 for rewinding of the tape and would serve to replace the conventional hand crank.

Also, one of the end caps 50,50 can be removed either for initial assembly or for replacement of the tape if necessary. This feature is, to some degree, optional but does permit access to the interior of the board but without sacrificing the security of the apparatus. Also, while two end caps 50,50 are shown, one would suffice.

It should be noted that the normal metal ring is not illustrated nor is any means illustrated for anchoring the toe board to either the ring or the ground since these are common expedients in this art and would be well known to anyone who has reasonable skill therein.

FIG. 4 shows a possible modification of the invention wherein the tape measure 130 is oriented in an upright condition. The casing of the tape measure has a plurality of rollers 134,134 secured thereto which are received in tracks 120,120. Top surface 111 of board 110 has an opening 115 to receive handle 141 so that the tape measure 130 can be moved along the board 110 as described above with regard to the form of the invention shown in FIGS. 1 through 3 and tape 133 can be drawn out through opeining 116.

In this form of the invention, one of the end caps would have a through central aperture for rewinding purposes as described above with respect to opening 17.

Accordingly then, it has been shown how an improved toe board and measuring apparatus can be produced which insures that the tape necessary to actually utilize the toe board is always present. Furthermore, the accuracy of the measurement will be enhanced by the ability of the tape to be moved along the arc formed by the toe board.

While a full and complete description has been set forth in accordance with the dictates of the patent statutes, it should be understood that modifications can be resorted to without departing from the spirit hereof or the scope of the appended claims.

Thus, for example, the board is not intended to be limited to any specific material athough wood is probably the most common presently used. It is believed that the essence of the present invention would have equal utility regardless of the board material.

What is claimed is:

1. An athletic toe board assembly comprising (A) an elongate restraining board of generally rectangular cross sectional configuration and arcuate planar configuration having
  (1) a top surface;
  (2) a convex front surface; and
  (3) an elongate arcuate internal track extending at least partially along its longitudinal axis;

(B) said top surface having a first arcuate elongate access opening therein
  (1) extending along the longitudinal axis thereof and
  (2) communicating with said track;

(C) said front surface having a first elongate access opening therein
  (1) extending along the longitudinal axis thereof and
  (2) communicating with said track; and (D) a spool-like tape measure
  (1) disposed within said track for movement therealong,
  (2) said spool-like tape measure including a spool and a measuring tape wound around said spool
  (3) said spool being accessible from said top surface of said board through said elongate access opening thereof and
  (4) one end of said tape being extendable through said elongate access opening of said front surface;

(E) elongate operating handle means received in said first access opening in said top surface one end of which is connected to said spool-like tape measure and the other end of which extends through said first access opening in said top surface and is provided with grasping means disposed only on said top surface
  (1) whereby said tape measure may be moved along said track.

2. The assembly of claim 1 wherein said track, said first access opening in said top surface and said first access opening in said front convex surface are substantially equal in length.

3. The assembly of claim 1 wherein said front surface has a second access opening therein communicating with said track and providing access to said spool-like tape measure.

4. The assembly of claim 1 wherein said restraining board has opposed ends; and a removable end cap releasably secured to at least one of said ends.

* * * * *